United States Patent [19]

Yamamoto et al.

[11] Patent Number: 4,614,700

[45] Date of Patent: Sep. 30, 1986

[54] IMAGE FORMING PROCESS WITH MAGNETIC BRUSH DEVELOPMENT

[75] Inventors: Yoko Yamamoto; Kunio Shigeta; Jiro Takahashi, all of Hachioji, Japan

[73] Assignee: Konishiroku Photo Industry Co., Ltd., Tokyo, Japan

[21] Appl. No.: 794,618

[22] Filed: Nov. 4, 1985

[30] Foreign Application Priority Data

| | | | |
|---|---|---|---|
| Nov. 15, 1984 | [JP] | Japan | 59-239539 |
| Nov. 16, 1984 | [JP] | Japan | 59-240541 |
| Nov. 26, 1984 | [JP] | Japan | 59-247969 |

[51] Int. Cl.[4] ..... G03G 13/09

[52] U.S. Cl. ..... 430/122; 430/106.6; 430/108

[58] Field of Search ..... 430/106.6, 108, 122

[56] References Cited

U.S. PATENT DOCUMENTS

| | | | |
|---|---|---|---|
| 3,798,167 | 3/1974 | Kukla et al. | 430/108 X |
| 4,394,429 | 7/1983 | Hays | 430/122 X |
| 4,499,169 | 2/1985 | Haneda et al. | 430/122 X |

FOREIGN PATENT DOCUMENTS

| | | | |
|---|---|---|---|
| 54-68246 | 6/1979 | Japan | 430/108 |
| 57-99653 | 6/1982 | Japan | 430/108 |
| 57-88460 | 6/1982 | Japan | 430/108 |
| 1438973 | 6/1976 | United Kingdom | 430/108 |

*Primary Examiner*—Roland E. Martin

*Attorney, Agent, or Firm*—Frishauf, Holtz, Goodman & Woodward

[57] ABSTRACT

In a process for forming an image comprising;

(i) forming a latent image on a latent image bearing member comprising an organic photoconductive photosensitive member;

(ii) forming a magnetic brush with a two-component developer comprising a toner and a carrier on a developer conveying support arranged as opposed to the latent image bearing member; and (iii) developing the latent image by brushing it with the magnetic brush in a developing region;

the improvement wherein an absolute value of a maximum potential (V) of a charge for forming the latent image is from 400 to 700, a minimum value of a gap between the photosensitive member and the developer conveying support is from 0.30 to 0.65 mm, the carrier comprises a core material and a polymer comprising a monomer component represented by the followng formula (I), (II) or (III):

Formula (I)

Formula (II)

Formula (III)

wherein $R^1$ and $R^2$ each represent a hydrogen atom or a methyl group; each of n and p represents an integer of 1 to 8; each of m and q represents an integer of 1 to 19; $X^1$, $X^2$, $X^3$ and $X^4$ each represent a hydrogen atom, a chlorine atom, a fluorine atom, a lower perfluoroalkyl group or a lower perfluoroalkoxy group, which may be either identical or different, and at least 2 of $X^1$, $X^2$, $X^3$ and $X^4$ are fluorine atoms.

According to this process, clear images with high image density and yet without image irregularity can be stably obtained.

11 Claims, 7 Drawing Figures

IMAGE FORMING PROCESS WITH MAGNETIC BRUSH DEVELOPMENT

BACKGROUND OF THE INVENTION

This invention relates to an image forming method including the step of developing electrostatic latent images formed in electrophotography, electrostatic recording, electrostatic printing, etc. by use of an organic photoconductive photosensitive member with a two-component developer.

At present, for formation of a visible image from a certain image information, a method through electrostatic latent images such as electrophotography, etc. has been widely used. For example, according to an example of electrophotography, electrostatic latent images formed on a latent image bearing member comprising a photoconductive photosensitive member by the charging step and the exposure step is developed with a developer comprising electroscopic colored particles called toner, and the toner image is ordinarily transferred onto a transfer material and fixed to give a visible image.

The developers to be used in development of such electrostatic latent images may be classified into the so-called two-component developer comprising a mixture of toner and carrier and the so-called one-component developer comprising a magnetic toner containing magnetic material which is to be used solely without being mixed with carrier. In the system employing the two-component developer, toner is subjected to triboelectric charging by stirring mechanically toner with carrier, whereby it is possible to control to a considerable extent the polarity of charging and the amount of charging of the toner by choosing the characteristics of the carrier, the conditions of stirring, etc. In this respect, the two-component developer is superior to the one-component developer.

The developing method includes the magnetic brush method, the cascade method, etc., of which the magnetic brush has preferably been employed. The magnetic brush method is a method, in which spikes of developer erected in a shape of brush by magnetic force on a developer conveying support, namely, magnetic brush, is formed and the magnetic brush is brushed against the surface of a latent image bearing member, thereby attaching toner particles onto electrostatic latent images to effect development.

In the developing method utilizing such a magnetic brush method, etc., the intensity of the electrical field in the developing region is one of the important conditions which determine the developing characteristic. And, as the factors defining such an intensity of the electrical field, there are the surface potential when the photoconductive photosensitive member constituting the latent image bearing member is charged, the distance between the latent image bearing member and the developer conveying support in the developing region and the electrical resistance of the developer (particularly carrier in the two-component developer), and the intensity of the electrical field is determined depending on the relationships among these factors.

On the other hand, it is recently desired to use an organic photoconductive photosensitive member, which is appreciated in not only high durability at high temperature and stable photosensitive characteristic over a long term but also in high safety with an additional advantage of low cost. However, in such an organic photoconductive photosensitive member, due to generally small photosensitivity, the potential difference between the non-image portion irradiated by light in the exposure step and the image portion not irradiated by light. For this reason, in the image forming method employing an organic photoconductive photosensitive in general, the density of the visible image obtained is disadvantageously low. Also, an organic photoconductive photosensitive member has very delicate characteristics and therefore slight fluctuation in developing conditions may have a great influence on the visible image, whereby there is involved the problem such that it is difficult to obtain excellent visible images stably.

SUMMARY OF THE INVENTION

This invention has been accomplished under the state of the art as described above and its object is to provide an image forming method capable of forming an image which is free from irregularity and of high quality having a high image density for a number of times stably.

The above object can be accomplished by, in a process for forming an image comprising;

(i) forming a latent image on a latent image bearing member comprising an organic photoconductive photosensitive member;

(ii) forming a magnetic brush with a two-component developer comprising a toner and a carrier on a developer conveying support arranged as opposed to said latent image bearing member; and (iii) developing said latent image by brushing it with said magnetic brush in a developing region;

the improvement wherein an absolute value of a maximum potential (V) of a charge for forming said latent image is from 400 to 700, a minimum value of a gap between said photosensitive member and said developer conveying support is from 0.30 to 0.65 mm, said carrier comprises a core material and a polymer comprising a monomer component represented by the following formula (I), (II) or (III):

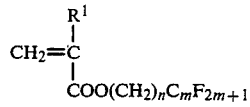

Formula (I)

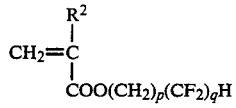

Formula (II)

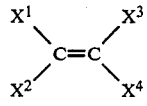

Formula (III)

wherein $R^1$ and $R^2$ each represent a hydrogen atom or a methyl group; each of n and p represents an integer of 1 to 8; each of m and q represents an integer of 1 to 19; $X^1$, $X^2$, $X^3$ and $X^4$ each represent a hydrogen atom, a chlorine atom, a fluorine atom, a lower perfluoroalkyl group or a lower perfluoroalkoxy group, which may be either identical or different, and at least 2 of $X^1$, $X^2$, $X^3$ and $X^4$ are fluorine atoms.

DESCRIPTION OF THE PREFERRED EMBODIMENTS

Figure 1:
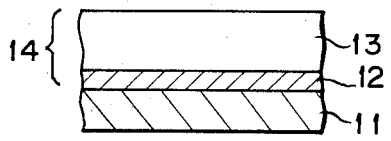
FIGS. 1 through 6 are sectional views of mechanical constitutional examples of organic photoconductive photosensitive members, respectively.

In this invention, a latent image bearing member comprising an organic photoconductive photosensitive member (hereinafter also called as "OPC photosensitive member") and a developer conveying support are arranged as opposed to each other through a developing region, moving the electrostatic latent image formed on the latent image bearing member to the developing region while moving the latent image bearing member simultaneously with conveying a magnetic brush constituted of two-component developer comprising a toner and a carrier into the developing region, and brushing the electrostatic latent image on the latent image bearing member in the developing region with the magnetic brush to thereby effect development through attachment electrostatically of the toner particles in the magnetic brush onto the electrostatic latent image. In the above steps, the following conditions (a) to (c) are required to be satisfied:

(a) the OPC photosensitive member constituting the latent image bearing member should have an absolute value of the maximum potential of the electrostatic latent image when charged (usually charged to be negative) which is within the range of from 400 to 700 V;

(b) the minimum value (Dsd) of the gap between the latent image bearing member and the developer conveying support in the developing region should be within the range of from 0.30 to 0.65 mm; and (c) the carrier should have a core material and a fluorine containing polymer obtained from a monomeric composition composed mainly (preferably containing 50% by weight or more) of a monomer represented by the above formula (I), (II) or (III) or a composition containing said polymer.

By satisfying these conditions (a), (b) and (c), the electric field state in the developing region can be made adequate to enable accomplishment of good developing, with the result that an image of high quality which is high in image density and yet suppressed in generation of image irregularity or fog can be formed.

When the absolute value of the maximum potential (V) of the electrostatic latent image in the OPC photosensitive member constituting the latent image bearing member is outside the range of the condition (a) and its value is less than 400, it becomes difficult to obtain a required electric field intensity; while if it exceeds 700, it is necessary to make the film thickness of the OPC photosensitive member larger, whereby sensitivity is undesirably lowered for practical application.

When the minimum value (Dsd) of the gap between the latent image bearing member and the developer conveying support is outside the range of the condition (b) and is less than 0.30 mm, no uniform developing action can be attained in the developing region to give rise readily to image irregularity. On the other hand, when the minimum value of the gap (Dsd) exceeds 0.65 mm, the opposed electrode effect between the toner particles and the latent image will be lowered in the developing region to lower readily image density, whereby there will also appear greatly the edge effect of relatively increased toner attachement on the outline portion relative to the central portion of the latent image.

By satisfying the condition (c) for the carrier, the carrier can be electrically insulating, having an electrical resistivity value ordinarily of $10^{13}$ Ω·cm or more. As a result, there will be caused no leak phenomenon, namely, the phenomenon in which charges of the electrostatic latent image formed on the latent image bearing member through a magnetic brush formed by the two-component developer containing the carrier or charges of toner are leaked out. Accordingly, the charges of the electrostatic latent image can be prevented from change in distributed state or the charged state of toner can be prevented from worsening to an inadequate state with occurence of image irregularity, whereby good developing can be accomplished. The aforesaid electrical resistivity value refers to a value which is obtained by calculating according to the formula shown below the measured current value (i ampere) when a sample is placed in a cell for measurement with a cross-sectional area of 1 $cm^2$ (F $cm^2$) to a depth of 0.03 to 0.08 cm (h cm) and, under a weight of 1 Kg applied on the above surface, the applied voltage (V volt) is changed:

$$\text{Electrical resistivity value } \rho\ (\Omega \cdot \text{cm}) = \frac{V \times F}{i \times h}$$

Further, the carrier having a coating layer of the fluorine containing polymer or the composition containing the polymer as described above, since the fluorine containing polymer tends greatly to be negatively charged, positive charging function for the toner is good and therefore the developing characteristic in the OPC photosensitive member to which negative surface potential is ordinarily imparted can be made sufficiently high, whereby improvement of image density as well as prevention of fog generation can be accomplished. Besides, the fluorine containing polymer is excellent in water resistance to increase durability of the carrier.

This invention is to be described in more detail below.

The developer conveying support for feeding a two-component developer to a developing region may preferably be, for example, a developing sleeve. Developing sleeve may consist of a plurality of sleeves or one sleeve, but more preferable image formation can be effected in a developing sleeve consisting of one sleeve. The developer conveying support may have a structure on which a bias voltage can be applied, for example, may be constituted of a cylindrical sleeve for supporting a magnetic brush on its surface and a magnet having plurality of poles arranged internally of the sleeve, whereby the magnetic brush on the sleeve can be conveyed by rotation of the sleeve into the developing region.

The magnetic brush supported on a developer conveying support should be preferably conveyed into the developing region under the state of uniform height in order to effect uniform development without irregularity. For this purpose, it is preferred to provide a doctor blade in the upper stream of the developing region of the developer conveying support for regulating the height of the magnetic brush to thereby cut the height of the brush to a constant level. The doctor blade may be made of either a magnetic material or a non-magnetic material. The distance between the edge of the doctor blade and the surface of the developer conveying support (Hcut) is set depending on the size of the gap between the latent image bearing member and the developer conveying support (Dsd). In order that the top of the magnetic brush may contact moderately the surface to be developed of the latent image bearing member and yet the toner may be supplied to the developing region in an amount enough to give high image density, the distance (Hcut) should be preferably made about 0.8-fold of the minimum value of gap (Dsd).

A bias voltage may be applied on the developing region, if desired. The bias voltage is generally only direct current voltage, but it may alternatively a direct current voltage on which an alternating current voltage is overlapped. In the latter case, in addition to the effect of preventing attachment of toner particles on the background portion other than the latent image portion by the direct current voltage, the toner particles become readily to be scattered from the carrier particles by the alternating current to improve toner attachability onto the latent image. The voltage may have its absolute value of about 0 to 300 V. The effective value of the alternating current may be, for example, about 100 V to 5 KV, its frequency being preferably, for example, 100 Hz to 10 KHz.

The toner image formed in the developing step as described above is transferred onto a transfer material such as paper according to, for example, the electrostatic transferring method, and the transferred image is fixed in the fixing machine according to, for example, the contact heating fixing system by means of heated rollers, whereby a visible image can be formed.

The latent image bearing member to be used in this invention comprises an organic photoconductive photosensitive member (OPC photosensitive member). The OPC photosensitive member is constituted by forming a photosensitive layer comprising a photoconductive substance of an organic compound, either alone or optionally dispersed in a binder resin, on an electroconductive substrate. Such a photosensitive layer should preferably be made of a two-layer structure having a carrier generation layer comprising a carrier generation substance which generates charged carriers by absorption of visible light combined with a carrier transport layer containing a carrier transport substances which transports either one or both of the positive or negative carriers generated in the carrier generation layer. Thus, by permitting separate layers to bear the two basic functions necessary in the photosensitive layer of generation of carrier and its transport, respectively, the scope of choice of materials useful for constitution of the photosensitive layer can be broadened and it becomes possible to select independently the substances or the substance systems which can optimally fulfill the respective functions. Also, by doing so, a photosensitive member having various characteristics demanded in electrophotographic process, for example, high surface potential when charged, great charge retentivity, high photosensitivity, great stability in repeated uses, etc. can be constituted.

Such carrier generating substances may include, for example, anthanthrone type pigments, perylene derivatives, phthalocyanine type pigments, azo type dyes, indigoid type dyes, etc., and the carrier transport substances may include, for example, carbazole derivatives, oxadiazole derivatives, triarylamine derivatives, polyarylalkane derivatives, hydrazone derivatives, pyrazoline derivatives, stilbene derivatives, styryltriarylamine derivatives, etc.

The binder resin constituting the photosensitive layer in the OPC photosensitive member may be insulating resins, including, for example, addition polymerization type resins, polyaddition type resins and polycondensation type resins such as polyethylene, polypropylene, acrylic resins, methacryilc resins, vinyl chloride resins, vinyl acetate resins, epoxy resins, polyurethane resins, phenol resins, polyester resins, alkyd resins, polycarbonate resins, silicone resins, melamine resins, etc. as well as copolymer resins containing two or more of the recurring units of these resins, for example, insulating resins such as vinyl chloride-vinyl acetate copolymer resins, vinyl chloride-vinyl acetate-maleic anhydride copolymer resins, styrene-acrylic copolymer resins, etc. or otherwise polymeric organic semiconductors such as poly-N-vinylcarbazole, etc.

The material constituting the electroconductive support in the OPC photosensitive member may be, for example, a metal sheet such as of aluminum, nickel, copper, zinc, palladium, silver, indium, tin, platinum, gold, stainless steel, brass, etc.

Such OPC photosensitive members may take various mechanical constitutions, which are not particularly limited in this invention, and any constitution may be available.

Figure 2:
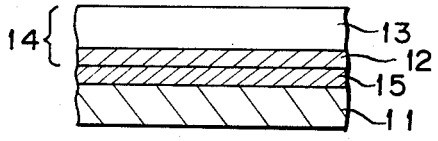
Figure 3:
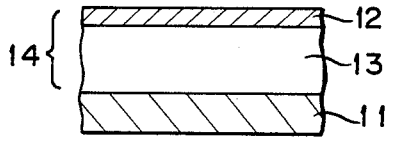
Figure 4:
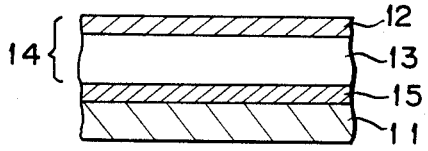
Figure 5:
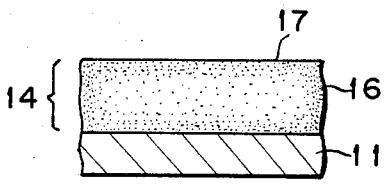
Figure 6:
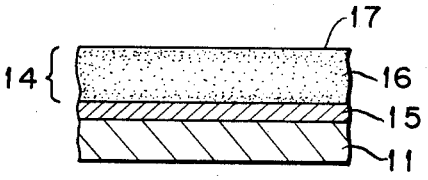

FIGS. 1 through 6 each show a mechanical constitutional example of OPC photosensitive member, and each of FIG. 1 and FIG. 3 is an example in which a photosensitive layer 14 constituted of a laminated member consisting of a carrier generation layer 12 composed mainly of a carrier generation substance and a carrier transport layer 13 containing a carrier transport substance as the main component is provided on an electroconductive substrate 11. Each of FIG. 2 and FIG. 4 is an example in which an intermediate layer 15 is provided between the photosensitive layer 14 and the electroconductive substrate 11. FIG. 5 and FIG. 6 are examples in which a photosensitive layer 14 having a carrier generating substance 17 dispersed in a layer 16 composed mainly of a carrier transport substance is provided on the electroconductive substrate 11 directly and through an intermediate layer 15, respectively.

The toner constituting the two-component developer to be used in this invention comprises toner components such as a colorant dispersed in a binder resin, and here there may be used various thermoplastic resins as the binder resin. Typical examples thereof may include, for example, polymers of monomers selected from styrenes such as styrene, p-chlorostyrene, α-methylstyrene and the like; α-methylene aliphatic monocarboxylic acid esters such as methyl acrylate, ethyl acrylate, n-propyl acrylate, lauryl acrylate, 2-ethylhexyl acrylate, methyl methacrylate, ethyl methacrylate, n-butyl methacrylate, lauryl methacrylate, 2-ethylhexyl methacrylate and the like; vinyl nitriles such as acrylonitrile, methacrylonitrile and the like; vinylpyridines such as 2-vinylpyridine, 4-vinylpyridine and the like; vinyl ethers such as vinyl methyl ether, vinyl isobutyl ether and the like; vinyl ketones such as vinyl methyl ketone, vinyl ethyl ketone, methyl isopropenyl ketone and the like; unsaturated hydrocarbons such as ethylene, propylene, isoprene, butadiene and the like and halogenated products thereof, halogen type unsaturated hydrocarbons such as chloroprene, etc., or copolymers obtained by combination of two or more of these monomers, and mixtures of these, or non-vinyl condensation type resins such as rosin-modified phenol-formalin resins, epoxy resins, polyester resins, polyurethane resins, polyamide resins, cellulose resins, polyether resins, etc., or mixtures of these resins with the above-mentioned vinyl type resins. The colorant may be, for example, carbon black, Nigrosine dyes, Aniline Blue, Chalcooil Blue, Chrome Yellow, Ultramarine Blue, Methylene Blue, Rose Bengal, Phthalocyanine Blue or a mixture of these. Other toner components than colorant may include charge controllers, off-set preventives, free flowability improvers, etc., and magnetic fine powder may also be contained, if desired.

Such a toner can be obtained according to the method for preparation of toner known in the art, and a toner with an average particle size of 20 μm or less, particularly from 8 to 12 μm, is preferred.

The carrier constituting the two-component developer to be used in this invention is particulate powder having a core material, a fluorine containing polymer containing a monomer represented by the above formula (I), (II) or (III) preferably in an amount of 50% by weight or more (hereinafter also called "specific polymer") or a composition containing the polymer and other substances which may be added, if desired.

As the monomers represented by the formula (I) and the formula (II), with respect to triboelectric charging characteristic, the monomers represented by the following formula (IV) and formula (V) are preferred:

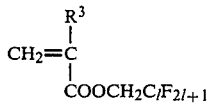

Formula (IV)

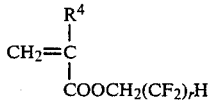

Formula (V)

wherein $R^3$ and $R^4$ each represent a hydrogen atom or a methyl group; l represents an integer of 1 or 2; and r represents an integer of 2 to 4.

Preferable monomers represented by the above formula (I) or (II) may include, for example, 1,1-dihydroperfluoroethyl methacrylate or 1,1,3-trihydroperfluoro-n-propyl methacrylate, etc.

As the polymers of the monomers represented by the above formula (I) or (II), there may be included those having the recurring units represented by the formulae as shown below, which are not, however, limitative of this invention.

[Exemplary compounds]

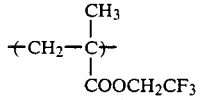

(1)

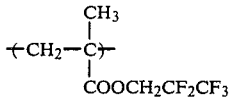

(2)

-continued

[Exemplary compounds]

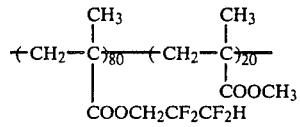

(3)

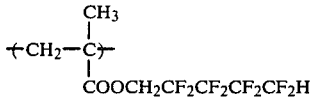

(4)

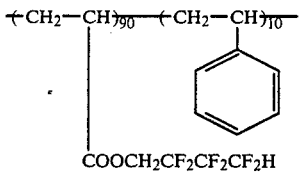

(5)

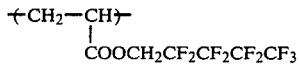

(6)

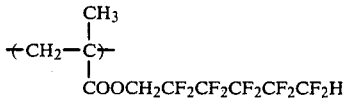

(7)

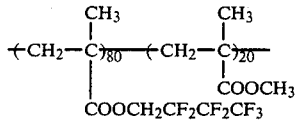

(8)

The monomers represented by the formula (III) may be exemplified by those represented by the following structural formulae:

$CF_2{=}CF_2$ "TFE" (tetrafluoroethylene); (1)

$CF_2{=}CF(CF_3)$ (hexafluoropropylene); (2)

$CF_2{=}CFCl$ "CTFE" (chlorotrifluoroethylene); (3)

$CH_2{=}CF_2$ "VdF" (vinylidene fluoride); (4)

$CF_2{=}CF(OC_3F_7)$ (perfluoropropylvinylether); (5)

The above specific polymer can be obtained by polymerization of a monomeric composition containing preferably 50% by weight or more of the above monomer (I), (II) or (III), and other monomers available may include, for example, ethylene, propylene, etc.

The substance which can be incorporated in the composition containing the above specific polymer may include, for example, polymers of monomers selected from styrenes such as styrene, p-chlorostyrene, α-methylstyrene and the like; α-methylene aliphatic monocarboxylic acid esters such as methyl acrylate, ethyl acrylate, n-propyl acrylate, lauryl acrylate, 2-ethylhexyl acrylate, methyl methacrylate, ethyl methacrylate, n-butyl methacrylate, lauryl methacrylate, 2-ethylhexyl methacrylate and the like; etc. or copolymers obtained by combination of two or more of these monomers, and mixtures thereof.

Examples of the above specific polymer are enumerated below:

(1)Vinylidene fluoride-tetrafluoroethylene copolymer: $-(CH_2CF_2)(CF_2CF_2)-$
(trade name)
"VT-100" (produced by Daikin Co.)
"VT-50" (produced by Daikin Co.)
"Kynar 7201" (produced by Pennwalt Co.)
(2) Polytetrafluoroethylene (PTFE): $-(CF_2CF_2)_n-$
(trade name)
"Algofron" (produced by Montecatint Edison Co.)
"Fluon" (produced by ICI Co.)
"Halon TFE" (produced by Allied Chemical Co.)
"Hostaflon" (produced by Hoechst Co.)
"Polyflon" (produced by Daikin Co.)
"Soreflon" (produced by Ugine Kuhlmann Co.)
"Teflon TFE" (produced by Du Pont Co.)
"Teflon J" (produced by Mitsui Fluorochemical Co.)
(3) Polychlorotrifluoroethylene (PCTFE): $-(CF_2CFCl)_n-$
(trade name)
"Daiflon" (produced by Daikin Co.)
"Kel-F" (produced by 3M Co.)
"Plaskon CTFE" (produced by Allied Chemical Co.)
"Voltalef" (produced by Ugine Kuhlmann Co.)
(4) Polyvinylidene fluoride (PVdF): $-(CH_2CF_2)_n-$
(trade name)
"Dulite" (produced by Du Pont Co.)
"Dyflor" (produced by Dynamit Nobel Co.)
"Fraflon" (produced by Ugine Kuhlmann Co.)
"KF polymer" (produced by Kureha Kagaku Co.)
"Kynar" (produced by Pennwalt Chemicals Co.)
"Solef" (produced by Solvay Co.)
(5) Tetrafluoroethylene-hexafluoropropylene copolymer (FEP):

$$-(CF_2CF_2)-(CF_2\underset{\underset{CF_3}{|}}{C}F)-$$

(trade name)
"Neoflon" (produced by Daikin Co.)
"Teflon FEP" (produced by Du Pont Co.)
(6) Tetrafluoroethylene-perfluoroalkyl vinyl ether copolymer (PFA):

$$-(CF_2CF_2)-(CF_2\underset{\underset{OC_3F_7}{|}}{C}F)-$$

(trade name)
"Teflon PFA" (produced by Du Pont)
(7) Tetrafluoroethylene-ethylene copolymer (ETFE): $-(CH_2CH_2)(CF_2CF_2)-$
(trade name)
"Aflon COP" (produced by Asahi Glass Co.)
"Tefzel" (produced by Du Pont Co.)
(8) Chlorotrifluoroethylene-ethylene copolymer (ECTFE): $-(CH_2CH_2)(CF_2CFCl)-$
(trade name)
"Halar" (produced by Allied Chemical Co.)
(9) Vinylidene fluoride-hexafluoropropylene copolymer:

$$-(CH_2CF_2)-(CF_2\underset{\underset{CF_3}{|}}{C}F)-$$

(trade name)
"Daiel" (produced by Daikin Co.)
"Viton" (produced by Du Pont Co.)
"Fluorel" (produced by 3M Co.)
"Technoflon N.FOR" (produced by Montedison Co.)
(10) Vinylidene fluoride-chlorotrifluoroethylene copolymer: $-(CH_2CF_2)(CF_2CFCl)-$
(trade name)
"Kel F Elastomer" (produced by 3M Co.)
(11) Vinylidene fluoride-pentafluoropropylene copolymer:
(trade name)
"Technoflon TS" (produced by Montedison Co.)
(12) Tetrafluoroethylene-perfluoronitrosomethane copolymer:
(trade name)
"Nitroso Rubber" (produced by Thiokol Chemical Co.)
(13) Tetrafluoroethylene-perfluoromethyl vinyl ether copolymer:

$$-(CF_2CF_2)-(CF_2\underset{\underset{OCF_3}{|}}{C}F)-$$

(trade name)
"Kalrez" (produced by Du Pont Co.)
(14) Tetrafluoroethylene-propylene copolymer:

$$-(CF_2CF_2)-(CH_2\underset{\underset{CH_3}{|}}{C}H)-$$

(trade name)
"Aflas" (produced by Asahi Glass Co.).

The carrier constituting the two-component developer to be used in this invention is not particularly limited in its constitution and may be constituted of, for example, cores comprising a magnetic material coated on their surfaces with a resin, or magnetic fine powder dispersed in a binder resin and others.

The resin for coating or binder which can be used in preparation of a resin coating carrier or a magnetic material dispersing type carrier may include homopolymers of monomers selected from styrenes such as styrene, p-chlorostyrene, methylstyrene and the like; vinyl halides such as vinyl chloride, vinyl bromide, vinyl fluoride and the like; vinyl esters such as vinyl acetate, vinyl propionate, vinyl benzoate, vinyl butyrate, etc.; α-methylene aliphatic monocarboxylic acid esters such as methyl acrylate, ethyl acrylate, n-butyl acrylate, isobutyl acrylate, dodecyl acrylate, n-octyl acrylate, 3-chloroethyl acrylate, phenyl acrylate, methyl α-chloroacrylate, methyl methacrylate, ethyl methacrylate, butyl methacrylate, etc.; vinyl nitriles such as acrylonitrile, methacrylonitrile and the like; vinyl ethers such as vinyl methyl ether, vinyl isobutyl ether, vinyl ethyl ether and the like; vinyl ketones such as vinyl methyl ketone, vinyl hexyl ketone, methyl isopropenyl ketone and the like; and so on, or other resins such as epoxy resins, rosin-modified formalin resins, cellulose resins, polyether resins, polyvinylbutyral resins, polyester resins, styrenebutadiene resins, polyvinylformal resins, polycarbonate resins, fluorine resins, etc., which can be used either alone or as a blend.

Among them, such resins as fluorine resins, vinyl chloride-vinyl acetate resins or polyester resins may preferably be used, particularly fluorine resins such as polyvinylidene fluoride, polytetrafluoroethylene, polyfluoro(meth)acrylate and the like.

The core material constituting the carrier is required to be constituted of a material capable of forming a magnetic brush, namely, a magnetic material, and such a magnetic material may include metals or alloys of metals exhibiting ferromagnetism such as iron, cobalt, nickel, etc. or compounds containing these elements, typically ferrite or magnetite, or alloys which contains no ferromagnetic element, but exhibits ferromagnetism by application of appropriate heat treatment, for example, various alloys called Whisler alloys containing manganese and copper such as manganese-copper-aluminum, manganese-copper-tin, etc., or chromium dioxide, and others.

When the carrier is to be made of a resin coating carrier, it can be prepared, for example, as follows. That is, the specific polymers or compositions containing the specific polymers as described above is dissolved in a solvent such as ketones (e.g. acetone, methyl ethyl ketone, etc.), tetrahydrofuran, dioxane, dimethyl sulfoxide, etc. to prepare a coating solution, which is then applied on the surface of the core material followed by drying, thereby forming a coating layer on the surface of the core material. Although this application may be practiced by use of the dipping method, the spraying method, etc., it is particularly preferred to use the fluidized bed method. The fluidized method is a method in which the core material is elevated and floated to an equilibrated height by an ascending pressurized gas stream in a fluidized bed apparatus and the above coating solution is sprayed from above before the core material falls down again to coat the respective core material, which procedure being repeated to form a coating with a desired thickness, whereby uniform coating layer can be formed on respective core material.

The coating layer should preferably have a thickness of 0.2 to 5 μm, particularly 0.5 to 2 μm, and the particle size of the carrier may be, for example, 30 to 200 μm, preferably 40 to 120 μm, particularly preferably 50 to 75 μm. If the particle size is less than 30 μm, the fluidity of the carrier is low and the ability of conveying the toner to the developing region is small to result readily in lowering in image density. Besides, because coating treatment becomes difficult during preparation of the carrier, it is difficult to obtain a uniform coated layer with the carrier of such small sizes. On the other hand, when the particle size exceeds 200 μm, the surface area of the carrier particles as a whole per a unit of weight is small and therefore the ability of conveying the toner to the developing region is small, whereby image density is liable to be lowered.

The carrier to be used in this invention may also incorporate additives such as charge controllers, flowability enhancers, etc., if desired.

In this invention, when such a coating carrier is used as the carrier, the carrier is excellent in humidity resistance and the triboelectric charging characteristic can be obtained stably for a long time. As the result, even when the carrier is provided for repeated uses, the charging characteristic and the charged quantity of the carrier are stable for a long time, with generation of weakly charged toner or toner charged to the opposite polarity being suppressed, whereby it becomes possible to perform good development stably.

When the carrier is made of the type in which magnetic material is dispersed, it can be prepared according to the same method as conventionally used in the prior art, for example, the method following the steps of kneading of the carrier starting materials, cooling, crushing and classification, or the method following various polycondensation steps. The carrier particles thus obtained may have sizes of, for example, 10 to 50 μm, preferably 15 to 40 μm, particularly preferably 20 to 30 μm. The carrier particles may be preferably treated to be shaped in spheres for improvement of fluidity.

Figure 7:
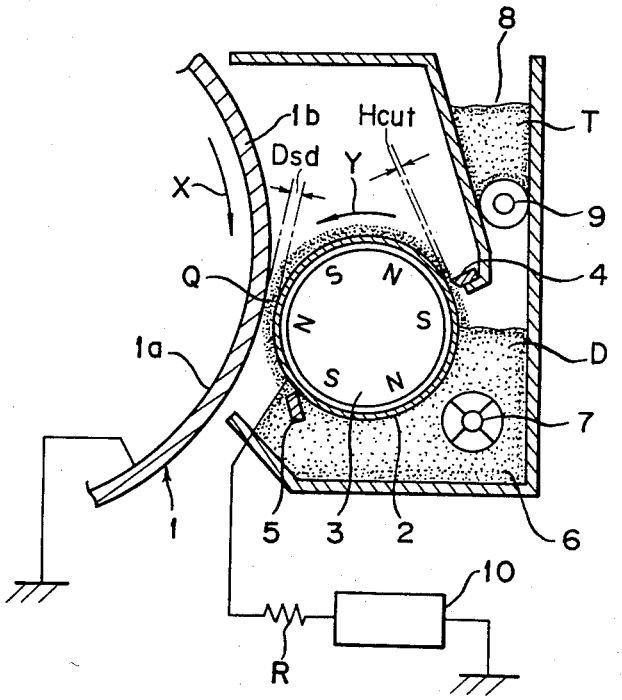
FIG. 7 is a sectional view for schematic illustration of an example of the developing device which can be used for performing the developing step in practice of this invention.

Referring now to an example of a specific device which can be used for practicing the developing steps in this invention, an embodiment of this invention is to be described below. FIG. 7 shows an example of the device and, in FIG. 7, 1 is a latent image bearing member shaped in a rotatory drum comprising an OPC photosensitive member, which is constituted of, for example, a photosensitive layer 1*b* made of an organic photoconductive substance laminated on an aluminum cylindrical photoconductive substrate 1*a*. The latent image bearing member 1 is rotated in the direction of the arrowhead X, charged by a charger (not shown) at the surface to be developed to a constant potential within the range of from −400 to −700 V at the upstream side of the developing region Q and then the electrostatic image corresponding to the manuscript is formed by means of an exposure device (not shown), followed by movement of the electrostatic latent image to the developing region Q for development.

A developer conveying support is constituted of a sleeve 2 consisting of a non-magnetic material such as aluminum, which is arranged as opposed to the latent image bearing member 1 so that the minimum value (Dsd) of the gap between said latent image bearing member 1 and said sleeve in the developing region Q may be within the range of from 0.30 to 0.65 mm, and a magnet 3 having a plurality of N and S poles provided internally of the sleeve 2 along the peripheral thereof. These sleeve 2 and magnet 3 are relatively retatable to each other and, in the embodiment shown in the Figure, the sleeve 2 is rotated so that it may move in the direction of the arrowhead Y, namely in the same direction as that of the movement of the latent image bearing member 1 in the developing region Q, while the magnet 3 is fixed.

The N and S poles of the magnet 3 are magnetized to a magnetic density generally of 500 to 1500 gauss, and the layer of the developer D comprising spikes erected in a shape of brush, namely a magnetic brush, is formed on the surface of the sleeve 2 through its magnetic force. A doctor blade 4 consisting of a magnetic or non-magnetic material regulates the height and the amount of the magnetic brush, and a cleaning blade 5 removes the magnetic brush which has passed through the developing region Q from the sleeve 2. The surface of the sleeve 2 after cleaning contacts again the developer D in a developer reservoir 6 to form a new magnetic brush, thereby feeding the developer D. A stirring screw 7 is used to stir the developer D in the developer reservoir 6 and make the components uniform. In the developer D in the developer reservoir 6, while the carrier is used repeatedly, the toner is consumed every time with development and therefore new toner particles T are supplemented suitably from a toner hopper 8. Toner particles T are falled into the developer reservoir 6 by the feeding rollers 9 having concave portions on the surface. The sleeve 2 is applied with a bias voltage through a protective resistance R from a bias power source 10.

In development of an electrostatic latent image, the edge of the magnetic brush should preferably contact shallowly the surface of the latent image bearing member 1 for effecting uniform development and, for this purpose, the distance (Hcut) between the edge of the doctor blade 4 and the surface of the sleeve 2 should preferably be made about 0.8-fold of the minimum value of the gap (Dsd) between the latent image bearing member 1 and the sleeve 2 in the developing region Q.

In the device as described above, since the magnitude and the direction of the magnetic field on the surface of the sleeve 2 will change with rotation thereof, the carrier particles on the surface of the sleeve 2 are conveyed to the developing region Q while under rotational vibration following the rotational movement of the sleeve 2.

As described in detail above, according to this invention, in an image forming method including the developing step of performing development by brushing a magnetic brush formed by a two-component developer on the developer conveying support against a latent image bearing member comprising an OPC photosensitive member, by specifying the carrier for the above two-component developer and the minimum value (Dsd) of the gap between the latent image bearing member and the developer conveying support, the electric field state in the developing region can be made adequate through the relationshipes between these factors and therefore good development can be accomplished in the developing step by use of an OPC photosensitive member in which high image density can be generally obtained with difficulty due to its low photosensitivity. As a result, while obtaining sufficiently the benefits by use of an OPC photosensitive member such as high durability at high temperature or stable photosensitive characteristic over a long period, clear images of high image density and yet without image irregularity can be stably obtained.

This invention is described by referring to the following Examples, by which this invention is not limited.

EXAMPLES 1 TO 9 AND COMPARATIVE EXAMPLES 1 TO 5

Carrier

Each 15 g of the polymers (1) to (6) of which recurring units are represented by the following formulae was dissolved in 500 ml of a solvent mixture of acetone-methyl ethyl ketone (weight ratio=1:1) (or 1,1,2-trifluoro-1,2,2-trichloroethane) to prepare 6 kinds of coating solutions. By use of these coating solutions, 1 kg of a core material comprising spherical iron powder "DSP-135C" (produced by Dowa Teppun Kogyo Co.) was coated with each solution by means of a fluidized bed apparatus to obtain a carrier with a thickness of the coated layer of about 2 μm. These are called "Carrier A" to "Carrier F", respectively.

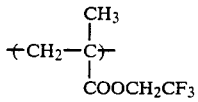
(1)

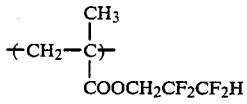
(2)

-continued

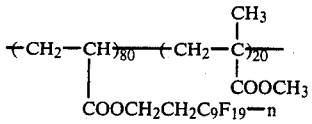
(3)

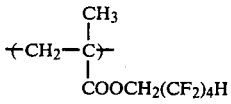
(4)

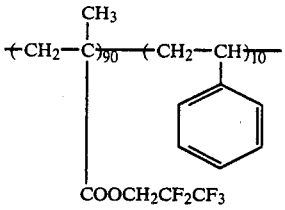
(5)

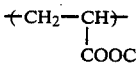
(6)

Comparative Carriers A and B:

On the other hand, by use of a methyl methacrylate-styrene copolymer (copolymer ratio=70:30), using methyl ethyl ketone as the solvent, carriers for comparative purpose were prepared in the same manner as described above. This is called "Comparative Carrier A". Further, as "Comparative Carrier B", negatively chargeable spherical coating carrier "C-1018" (produced by Nuclear Metals Co.) was used.

Every one of Carrier A to Carrier F and Comparative Carrier A and B as prepared above has an average particle size of 105 μm.

Toner

Toner A:

332 g of terephthalic acid, 90 g of polyoxypropylene-(2.2)-2,2-bis(4-hydroxyphenyl)propane and 587 g of bisphenol A were placed into a round bottomed flask equipped with a thermometer, a stirrer made of stainless steel, a nitrogen gas introducing tube made of glass and a flow-down type condenser. The flask was set in a mantle heater, and the temperature was elevated while maintaining the flask internally under an inert atomosphere by introducing nitrogen gas through the nitrogen gas introducing inlet. And, 0.05 g of dibutyl tin oxide was added and the reaction was carried out at 200° C. while monitoring the reaction at the softening point to obtain a polyester resin.

100 parts by weight of this polyester resin, 10 parts by weight of carbon black "Regal 660R" (produced by Cabot Co.), 2 parts by weight of a low molecular weight polypropylene "Viscol 660P" (produced by Sanyo Kasei Kogyo Co.) and 2 parts by weight of ethylene-bisstearoylamide "Hoechst Wax C" (produced by Hoechst Co.) were mixed in a ball mill and, following the respective steps of kneading, pulverization and classification, a toner with a mean particle size of 10 μm was obtained. This is called "Toner A".

Toner B:

100 parts by weight of a styrene-methyl methacrylate-n-butyl methacrylate copolymer obtained by the reaction of styrene, methyl methacrylate and n-butyl methacrylate at a molar ratio of 50:20:30, 10 parts by weight of carbon black "Regal 660P" (produced by Cabot Co.), 3 parts by weight of a low molecular weight polypropylene "Viscol 660P" (produced by Sanyo Kasei Kogyo Co.) were mixed in a ball mill and, following the respective steps of kneading, pulverization and classification, a toner with an average particle size of 11 μm was obtained. This is called "Toner B".

Toner C:

100 parts by weight of a styrene-methyl methacrylate-n-butyl methacrylate copolymer obtained by the reaction of styrene, methyl methacrylate and n-butyl methacrylate at a molar ratio of 50:20:30, 10 parts by weight of carbon black "Regal 660R" (produced by Cabot Co.), 3 parts by weight of a low molecular weight polypropylene "Viscol 660P" (produced by Sanyo Kasei Kogyo Co.) and 2 parts by weight of a Nigrosine dye "Oil Black SO" (produced by Orient Kagaku Co.) were mixed in a ball mill and, following the respective steps of kneading, pulverization and classification, a toner with an average particle size of 11 μm was obtained. This is called "Toner C".

Developer

The above Toner A to Toner C, the above Carrier A to Carrier F, Comparative Carrier A and Comparative Carrier B were mixed according to the combinations as shown in Table 1 to prepare 14 kinds of two-component developers containing 2% by weight of toner.

Photosensitive member

A photosensitive layer with a negatively chargeable two-layer structure formed by use of an anthanthrone type pigment as the carrier generation substance and a carbazole derivative as the carrier transport substance was laminated on a drum-shaped aluminum conductive substrate. This is called "OPC photosensitive member A".

The above OPC photosensitive member A was mounted as the latent image bearing member on a modified electrophotographic copying machine "U-Bix 3000" (produced by Konishiroku Photo Industry Co.) and continuous real copying tests were conducted for 10,000 times under the conditions shown below in Table 1 in respective Examples and Comparative Examples for examination of the maximum image density (Dmax) at an initial stage and a stage after copying 10,000 times and generation of fog. The results are also shown in Table 1. As for other conditions, the distance (Hcut) between the edge of the doctor blade and the sleeve is about Dsd×0.8 mm, the magnet is a fixed type, the magnetic flux density on the sleeve surface is 800 gauss, the bias voltage applied on the sleeve is −100 V of direct current voltage.

The maximum image density (Dmax) was evaluated in terms of the relative density with the image density of the original image as being 1.3 and, as to generation of fog, the area percentage of the black ground in the copied image corresponding to the white ground in the original image is evaluated by the value measured by means of a dot analysis device "Sakura Areaduck-100" (produced by Konishiroku Photo Industry Co.).

TABLE 1

| | Surface potential on latent image bearing member (V) | Carrier | Toner | Minimum value of gap: Dsd (mm) | Initial stage | | After copying 10,000 times | |
|---|---|---|---|---|---|---|---|---|
| | | | | | $D_{max}$ | fog (%) | $D_{max}$ | fog (%) |
| Example 1 | −400 | Carrier A | Toner A | 0.4 | 1.3 or more | 0.1 or less | 1.3 or more | 0.1 or less |
| Example 2 | −500 | Carrier A | Toner A | 0.3 | 1.3 or more | 0.1 or less | 1.3 or more | 0.1 or less |
| Example 3 | −500 | Carrier A | Toner A | 0.5 | 1.3 or more | 0.1 or less | 1.3 or more | 0.1 or less |
| Example 4 | −500 | Carrier B | Toner A | 0.65 | 1.3 or more | 0.1 or less | 1.3 or more | 0.1 or less |
| Example 5 | −700 | Carrier C | Toner A | 0.6 | 1.3 or more | 0.1 or less | 1.3 or more | 0.1 or less |
| Example 6 | −500 | Carrier D | Toner B | 0.5 | 1.3 or more | 0.1 or less | 1.3 or more | 0.1 or less |
| Example 7 | −500 | Carrier E | Toner B | 0.5 | 1.3 or more | 0.1 or less | 1.3 or more | 0.1 or less |
| Example 8 | −500 | Carrier E | Toner B | 0.4 | 1.3 or more | 0.1 or less | 1.3 or more | 0.1 or less |
| Example 9 | −500 | Carrier F | Toner A | 0.4 | 1.3 or more | 0.1 or less | 1.3 or more | 0.1 or less |
| Comparative Example 1 | −500 | Carrier A | Toner A | 0.2 | —(*1) | — | — | — |
| Comparative Example 2 | −500 | Carrier A | Toner A | 0.7 | 0.7 | 0.1 or less | — | — |
| Comparative Example 3 | −500 | Carrier D | Toner B | 0.8 | 0.6 | 0.1 or less | — | — |
| Comparative Example 4 | −500 | Comparative carrier A | Toner C | 0.4 | 1.3 | 0.1 or less | 0.8 | 0.6 |
| Comparative Example 5 | −500 | Comparative carrier B | Toner B | 0.4 | 1.3 | 0.1 or less | 0.7 | 0.5 |

(*1)Generation of image irregularity

EXAMPLES 10 TO 18 AND COMPARATIVE EXAMPLES 6 TO 10:

Carrier

Carrier G:

A coating solution was prepared by dissolving 15 g of a vinylidenefluoride-tetrafluoroethylene copolymer "VT-100" (produced by Daikin Kogyo Co.) in 500 ml of a solvent mixture of acetone-methyl ethyl ketone (weight ratio = 1:1) and 1 Kg of a core material comprising spherical iron powder "DSP-135 C" (produced by Dowa Teppun Kogyo Co.) was coated with this coating solution to obtain a carrier with a coated layer thickness of about 2 μm. This is called "Carrier G".

Carrier H:

A carrier was prepared in the same manner as in preparation of Carrier G except for preparing a coating solution from 9 g of a vinylidene fluoride-tetrafluoroethylene copolymer "VT-100" (produced by Daikin Kogyo Co.) and 6 g of a methyl methacrylate copolymer "Acrypet MF" (produced by Mitsubishi Rayon Co.). This is called "Carrier H".

Carrier I:

With the use of a suspension of a polytetrafluoroethylene "852-201 Clear Teflon Enamel" (produced by Du Pont Co.), coating treatment was carried out in the same manner as in preparation of Carrier G, followed further by heat treatment in a furnace at about 350° C. for one hour, subsequently cooling to room temperature and classification, to obtain a carrier. This is called "Carrier I".

Carrier J:

A coating solution was prepared by dissolving 25 g of a vinylidene fluoride-tetrafluoroethylene copolymer "VT-100" in 800 ml of a solvent mixture of acetone-methyl ethyl ketone (1:1), and 1 kg of a core material consisting of iron powder "DSP-229" (produced by Dowa Teppun Kogyo Co.) was coated with this coating solution by means of a fluidized bed apparatus to prepare a carrier with a film thickness of 2 μm. This is called "Carrier J".

Carrier K:

A carrier was prepared in the same manner as in preparation of Carrier J except for preparing a coating solution from 15 g of a vinylidene fluoride-tetrafluoroethylene copolymer "VT-100" and 10 g of a methyl methacrylate copolymer "Acrypet MF". This is called "Carrier K".

Carrier L:

A carrier was prepared in the same manner as in preparation of Carrier I except for using iron powder "DSP-229" as the core material. This is called "Carrier L".

On the other hand, by use of a methyl methacrylates-tyrene copolymer (copolymer ratio 70:30), using methyl ethyl ketone as the solvent, carriers for comparative purpose were prepared in the same manner as described above. This is called "Comparative Carrier C". Further, as "Comparative Carrier D", negatively chargeable spherical coating carrier "C-1018" (produced by Nuclear Metals Co.) was used.

Toner

Toner D:

The same toner as Toner A prepared in Examples 1 to 9 and Comparative Examples 1 to 5 was prepared similarly.

Toner E:

The same toner as Toner C prepared in Examples 1 to 9 and Comparative Examples 1 to 5 was prepared similarly.

Developer

The above Toner D and E, the above Carrier G to L, and Cpmparative Carrier C and D were mixed according to the combinations as indicated in Table 2 to obtain 14 kinds of two-component developers containing 2% by weight of toner.

Photosensitive member

The same photosensitive member as used in Examples 1 to 9 and Comparative Examples 1 to 5 was employed.

In the respective Examples and Comparative Examples, the same real copying tests were conducted in the same manner as in Examples 1 to 9 and Comparative examples 1 to 5 under the conditions indicated in Table 2. The results of the tests are shown in Table 2.

TABLE 2

| | Surface potential on latent image bearing member | | | Average particle size of carrier | Minimum value of gap Dsd | Initial stage | | After copying 10,000 times | |
|---|---|---|---|---|---|---|---|---|---|
| | (V) | Carrier | Toner | (μm) | (mm) | $D_{max}$ | fog (%) | $D_{max}$ | fog (%) |
| Example 10 | −500 | Carrier G | Toner D | 105 | 0.5 | 1.3 or more | 0.1 or less | 1.3 or more | 0.1 or less |
| Example 11 | −400 | Carrier H | Toner D | 105 | 0.5 | 1.3 or more | 0.1 or less | 1.3 or more | 0.1 or less |
| Example 12 | −500 | Carrier H | Toner D | 105 | 0.3 | 1.3 or more | 0.1 or less | 1.3 or more | 0.1 or less |
| Example 13 | −500 | Carrier H | Toner D | 105 | 0.65 | 1.3 or more | 0.1 or less | 1.3 or more | 0.1 or less |
| Example 14 | −700 | Carrier H | Toner D | 105 | 0.6 | 1.3 or more | 0.1 or less | 1.3 or more | 0.1 or less |
| Example 15 | −500 | Carrier I | Toner D | 105 | 0.5 | 1.3 or more | 0.1 or less | 1.3 or more | 0.1 or less |
| Example 16 | −500 | Carrier J | Toner D | 65 | 0.4 | 1.3 or more | 0.1 or less | 1.3 or more | 0.1 or less |
| Example 17 | −600 | Carrier K | Toner D | 65 | 0.5 | 1.3 or more | 0.1 or less | 1.3 or more | 0.1 or less |
| Example 18 | −600 | Carrier L | Toner D | 65 | 0.6 | 1.3 or more | 0.1 or less | 1.3 or more | 0.1 or less |
| Comparative Example 6 | −500 | Carrier H | Toner D | 105 | 0.2 | —(*1) | — | — | — |
| Comparative Example 7 | −500 | Carrier H | Toner D | 105 | 0.7 | 0.6 | 0.1 or less | — | — |
| Comparative Example 8 | −500 | Carrier K | Toner D | 65 | 0.7 | 0.6 | 0.1 or less | — | — |
| Comparative Example 9 | −500 | Comparative carrier C | Toner E | 105 | 0.6 | 1.3 or more | 0.1 or less | 0.8 | 0.6 |
| Comparative Example 10 | −500 | Comparative carrier D | Toner D | 120 | 0.6 | 1.3 or more | 0.1 or less | 0.7 | 0.5 |

As is apparent from the results in Tables 1 and 2, according to any of Examples 1 to 18 of this invention, images of sufficiently high image density without image irregularity and fog could be obtained. Also, clear images without fog could be obtained even after successive copying for 10,000 times.

In contrast, in Comparative Examples 1 and 6, because of too small minimum value Dsd of the gap, image irregularity was generated; in Comparative Examples 2, 3, 7 and 8, because of too large minimum value Dsd of the gap, image density was insufficient; and in Comparative Examples 4, 5, 9 and 10, although images of high image density without fog could be obtained at the initial stage of copying, the characteristics were markedly lowered with respect to both fog and image density to give no image of high quality after successive copying for 10,000 times.

We claim:

1. In a process for forming an image comprising;

(i) forming a latent image on a latent image bearing member comprising an organic photoconductive photosensitive member;

(ii) forming a magnetic brush with a two-component developer comprising a toner and a magnetic carrier on a developer conveying support arranged as opposed to said latent image bearing member; and (iii) developing said latent image by brushing it with said magnetic brush in a developing region;

the improvement wherein an absolute value of a maximum potential (V) of a charge for forming said latent image is from 400 to 700, a minimum value of a gap between said photosensitive member and said developer conveying support is from 0.30 to 0.65 mm, said carrier comprises a core material and a polymer comprising a monomer component represented by the following formula (I), (II) or (III):

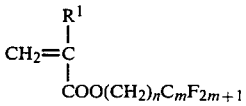

Formula (I)

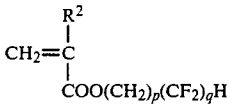

Formula (II)

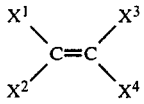

Formula (III)

wherein $R^1$ and $R^2$ each represent a hydrogen atom or a methyl group; each of n and p represents an integer of 1 to 8; each of m and q represents an integer of 1 to 19; $X^1$, $X^2$, $X^3$ and $X^4$ each represent a hydrogen atom, a chlorine atom, a fluorine atom, a lower perfluoroalkyl group or a lower perfluoroalkoxy group, which may be either identical or different, and at least 2 of $X^1$, $X^2$, $X^3$ and $X^4$ are fluorine atoms.

2. The process according to claim 1, wherein said carrier has an electric resistivity of $10^{13}$ Ω·cm or more.

3. The process according to claim 1, wherein said carrier has the structure comprising a core composed of said core material and a polymer layer provided on the surface thereof.

4. The process according to claim 3, wherein said carrier has a particle size within the range of 30 to 200 μm and said polymer layer has a thickness within the range of 0.2 to 5 μm.

5. The process according to claim 1, wherein the core material in said carrier is a metal or an alloy having ferromagnetic property, or an alloy exhibiting ferromagnetic property by heat treatment.

6. The process according to claim 1, wherein said polymer in said carrier contains said monomer component in an amount of 50% by weight or more.

7. The process according to claim 1, wherein said developer conveying support is a sleeve having a magnet therein.

8. The process according to claim 7, wherein a doctor blade for regulating the height and the amount of said magnetic material brush is equipped in the upper stream of the developing region.

9. The process according to claim 1, wherein said monomer constituting the polymer is selected from the group consisting of monomer components represented by the following formulae (IV) and (V):

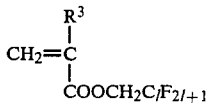

Formula (IV)

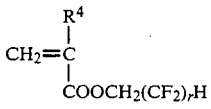

Formula (V)

wherein $R^3$ and $R^4$ each represent a hydrogen atom or a methyl group; l represents an integer of 1 or 2; and r represents an integer of 2 to 4.

10. The process according to claim 1, wherein said polymer in said carrier is selected from the group consisting of polymers represented by the following formulae (1) to (13):

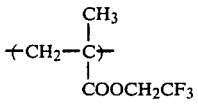

(1)

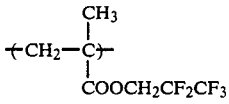

(2)

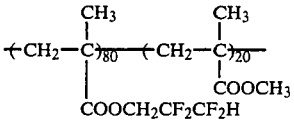

(3)

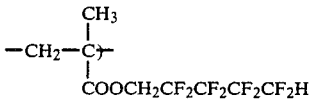

(4)

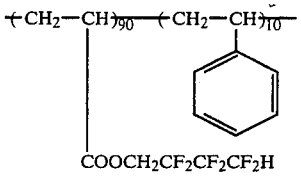

(5)

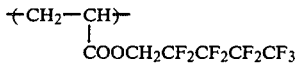

(6)

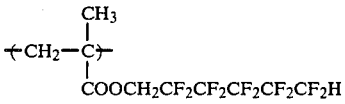

(7)

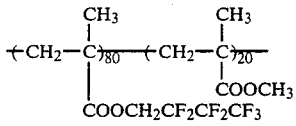

(8)

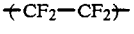

(9)

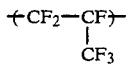

(10)

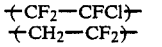

(11)

(12)

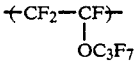

(13)

11. The process according to claim 1, wherein said toner has the particle size within an average range of 8 to 12 μm.

* * * * *